US009470176B2

(12) United States Patent
Beyer et al.

(10) Patent No.: US 9,470,176 B2
(45) Date of Patent: Oct. 18, 2016

(54) BORE BRIDGE AND CYLINDER COOLING

(71) Applicant: Ford Global Technologies, LLC, Dearborn, MI (US)

(72) Inventors: Theodore Beyer, Canton, MI (US); John Christopher Riegger, Ann Arbor, MI (US); Mohammed Yusuf Ali, Dearborn, MI (US); Daryl Gene Self, Trenton, MI (US); Jody Michael Slike, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 186 days.

(21) Appl. No.: 14/449,862

(22) Filed: Aug. 1, 2014

(65) Prior Publication Data

US 2016/0032814 A1 Feb. 4, 2016

(51) Int. Cl.

| | |
|---|---|
| ***F02F 1/10*** | (2006.01) |
| ***F02F 1/16*** | (2006.01) |
| *F02F 11/00* | (2006.01) |

(52) U.S. Cl.

CPC ..... *F02F 1/16* (2013.01); *F02F 11/002* (2013.01)

(58) Field of Classification Search

CPC ..... F01P 3/02; F01P 2003/027; F01P 2003/021; F01P 3/14; F02F 1/40; F02F 1/14; F02F 1/10; F02F 1/36; F02F 2001/104; F02F 1/166

USPC ..... 123/41.01, 41.72, 41.74, 41.82 R

See application file for complete search history.

(56) References Cited

U.S. PATENT DOCUMENTS

| | | | | |
|---|---|---|---|---|
| 4,369,739 | A * | 1/1983 | Umemura | F02F 1/14 123/41.74 |
| 4,683,844 | A * | 8/1987 | Arai | F02F 11/002 123/41.74 |
| 4,693,294 | A * | 9/1987 | Albrecht | F02F 1/108 123/41.74 |
| 4,850,312 | A * | 7/1989 | Schwab | F02F 1/108 123/41.74 |
| 5,086,733 | A * | 2/1992 | Inoue | F01P 3/02 123/41.79 |
| 5,558,048 | A * | 9/1996 | Suzuki | F02B 75/20 123/41.74 |
| 5,887,556 | A * | 3/1999 | Kim | F02F 1/14 123/41.72 |
| 7,278,381 | B2 * | 10/2007 | Matsutani | F01P 3/02 123/41.74 |
| 8,261,702 | B2 * | 9/2012 | Fedeson | F01P 3/02 123/41.82 R |

(Continued)

FOREIGN PATENT DOCUMENTS

| | | | | |
|---|---|---|---|---|
| DE | 4117112 | C1 * | 6/1992 | F02F 1/108 |
| JP | 07224716 | A * | 8/1995 | |

(Continued)

*Primary Examiner* — John Kwon
*Assistant Examiner* — Tea Holbrook
(74) *Attorney, Agent, or Firm* — Brooks Kushman P.C.; Greg P. Brown

(57) ABSTRACT

An engine includes a cylinder block having first and second passages intersecting a block face on opposed sides of a bore bridge defining a bore bridge cooling passage. A cylinder head has third and fourth passages intersecting a head face. The first and fourth passages are opposed from one another. A gasket is placed between the block and the head. The gasket adapted to fluidly connect the first and fourth passages via the bore bridge cooling passage, and cover the second passage.

19 Claims, 6 Drawing Sheets

(56) References Cited

U.S. PATENT DOCUMENTS

| | | | | |
|---|---|---|---|---|
| 8,555,825 | B2 * | 10/2013 | Lenz | F01P 3/02 123/193.3 |
| 8,814,171 | B2 * | 8/2014 | Beyer | F16J 15/0825 123/193.3 |
| 8,869,758 | B1 * | 10/2014 | Beyer | F02F 1/10 123/41.82 R |
| 2005/0046119 | A1 * | 3/2005 | Eckert | F01P 3/02 277/592 |
| 2010/0326380 | A1 * | 12/2010 | Fedeson | F01P 3/02 123/41.82 R |
| 2011/0023799 | A1 * | 2/2011 | Lenz | F01P 3/02 123/41.79 |
| 2013/0333658 | A1 * | 12/2013 | Yamamoto | F02F 1/10 123/195 R |
| 2014/0283763 | A1 * | 9/2014 | Wakamoto | F01P 3/02 123/41.01 |
| 2014/0331947 | A1 * | 11/2014 | Beyer | F01P 3/02 123/41.74 |

FOREIGN PATENT DOCUMENTS

| | | | |
|---|---|---|---|
| JP | 3707415 | B2 | 8/2005 |
| JP | 2010150989 | A | 7/2010 |

* cited by examiner

BORE BRIDGE AND CYLINDER COOLING

TECHNICAL FIELD

Various embodiments relate to cooling passages for a bore bridge between two cylinders in an internal combustion engine.

BACKGROUND

In a water-cooled engine, sufficient cooling may need to be provided to the bore bridge between adjacent engine cylinders. The bore bridge on the cylinder block and/or the cylinder head is a stressed area with little packaging space. In small, high output engines, due to packaging, the thermal and mechanical stresses may be increased. Higher bore bridge temperatures typically cause bore bridge materials to weaken and may reduce fatigue strength. Thermally weakened structure and thermal expansion of this zone may cause bore distortion that can be problematic to overall engine functionality such as, for example, piston scuffing, sealing functionality and durability of the piston-ring pack. Additionally, high temperatures at the bore bridge area also limit the reliability of the gasket in this zone, which in turn may cause combustion gas and coolant leaks, and/or reduced engine power output and overheating.

SUMMARY

In an embodiment, an internal combustion engine is provided with a cylinder block defining a block deck face, first and second cylinders, and a block cooling jacket. The first and second cylinders are adjacent to one another and separated by a block bore bridge. A cylinder head has a head deck face defining first and second chambers, and a head cooling jacket. The first and second chambers are adjacent to one another and separated by a head bore bridge. The first chamber and the first cylinder form a first combustion chamber, and the second chamber and the second cylinder form a second combustion chamber. A head gasket is positioned between the cylinder block and the cylinder head. The head gasket has a block side and a head side. The block cooling jacket has a first passage and a second passage intersecting the block deck face on either side of the block bore bridge. The first passage is on a first side of a longitudinal axis of the cylinder block. The head cooling jacket has a third passage and a fourth passage intersecting the head deck face on either side of the head bore bridge. The third passage is on the first side of the longitudinal axis of the cylinder block. The block bore bridge defines a bridge cooling passage extending from the first passage adjacent to the block deck face to the block deck face adjacent to the second passage. The head gasket is adapted to fluidly connect the first and fourth passages such that coolant flows from the first passage, through the bridge cooling passage, and to the fourth passage to cool the associated bore bridge.

In another embodiment, an engine is provided with a cylinder block having first and second passages intersecting a block face on opposed sides of a bore bridge defining a v-shaped passage. A cylinder head has third and fourth passages intersecting a head face, with the first and fourth passages being opposed. A gasket is placed between the block and the head. The gasket is adapted to fluidly connect the first and fourth passages via the v-shaped passage, and cover the second passage.

In yet another embodiment, a head gasket for an engine having a cooling jacket is provided. The gasket has a generally planar gasket body with a first side for cooperation with a cylinder head deck face, and a second side for cooperation with a cylinder block deck face. The gasket has a first aperture extending through the gasket body and adjacent to a cylinder block bore bridge. The first aperture fluidly connects a first cooling passage in a cylinder block and a second cooling passage in a cylinder head, with the first and second cooling passages being aligned. The gasket has a second aperture extending through the gasket body and adjacent to the cylinder block bore bridge. The second aperture fluidly connects a bridge cooling passage in the cylinder block bore bridge receiving fluid from the first passage and a third cooling passage in the cylinder head. The first and second apertures are spaced apart transversely on the gasket. The gasket body is adapted to cover a fourth passage in the cylinder block, with the fourth passage adjacent to the v-shaped passage.

Various embodiments of the present disclosure have associated, non-limiting advantages. For example, by providing a v-shaped passage or another passage across the bore bridge to provide coolant flow from a block cooling jacket to a head cooling jacket on an opposed side of a bore bridge, the bore bridge temperature, cylinder temperature, and relative cylinder vertical displacement may be reduced. A gasket fluidly connects the block cooling jacket and the head cooling jacket on a first side of the bore bridge. The bore bridge cooling passage is fluidly connected to the block jacket on the first side of the bridge and spaced apart from and fluidly disconnected from the block cooling jacket on the second, opposed side of the bore bridge. The gasket fluidly connects the bore bridge passage to the head cooling jacket on the second side of the bore bridge. The gasket covers the block cooling jacket on the second side of the bore bridge to prevent coolant flow from the block jacket to the head jacket on the second side of the bore bridge. The bore bridge cooling passage and head gasket provide for an increased pressure drop across the bore bridge, providing for increased coolant velocity and increased heat transfer of the bore bridge.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
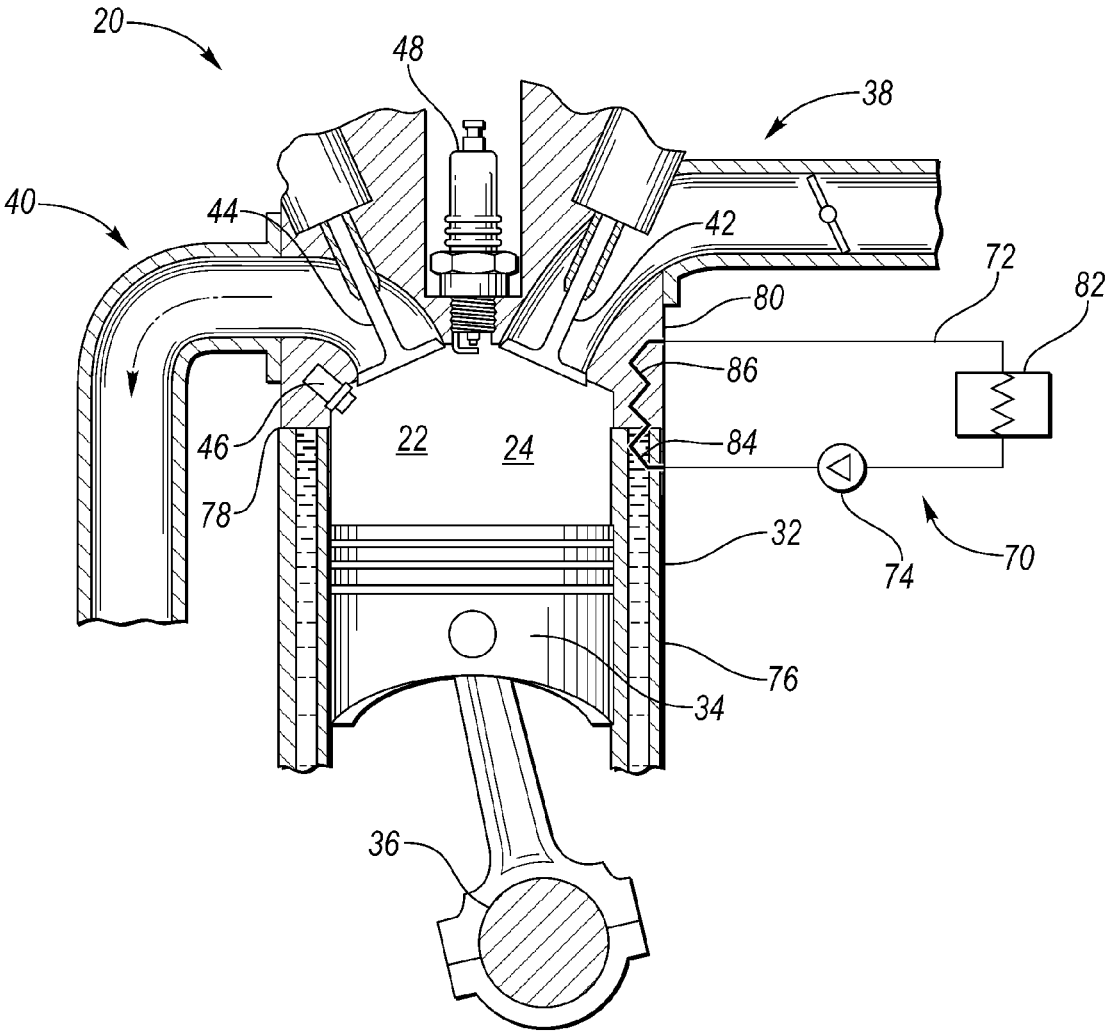
FIG. 1 illustrates a schematic of an engine configured to implement the disclosed embodiments.

FIG. 1 illustrates a schematic of an internal combustion engine 20. The engine 20 has a plurality of cylinders 22, and one cylinder is illustrated. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an after treatment system such as a catalytic converter.

The intake and exhaust valve 42, 44 positions and timing, as well as the fuel injection timing and ignition timing may be varied for the various engine strokes.

The engine 20 includes a cooling system 70 to remove heat from the engine 20. The amount of heat removed from the engine 20 may be controlled by a cooling system controller or the engine controller. The cooling system 70 may be integrated into the engine 20 as a cooling jacket. The cooling system 70 has one or more cooling circuits 72 that may contain water or another coolant as the working fluid. In one example, the cooling circuit 72 has a first cooling jacket 84 in the cylinder block 76 and a second cooling jacket 86 in the cylinder head 80 with the jackets 84, 86 in fluid communication with each other. The block 76 and the head 80 may have additional cooling jackets. Coolant, such as water, in the cooling circuit 72 and jackets 84, 86 flows from an area of high pressure towards an area of lower pressure.

The cooling system 70 has one or more pumps 74 that provide fluid in the circuit 72 to cooling passages in the cylinder block 76. The cooling system 70 may also include valves (not shown) to control to flow or pressure of coolant, or direct coolant within the system 70. The cooling passages in the cylinder block 76 may be adjacent to one or more of the combustion chambers 24 and cylinders 22, and the bore bridges formed between the cylinders 22. Similarly, the cooling passages in the cylinder head 80 may be adjacent to one or more of the combustion chambers 24 and cylinders 22, and the bore bridges formed between the combustion chambers 24. The cylinder head 80 is connected to the cylinder block 76 to form the cylinders 22 and combustion chambers 24. A head gasket 78 in interposed between the cylinder block 76 and the cylinder head 80 to seal the cylinders 22. The gasket 78 may also have a slot, apertures, or the like to fluidly connect the jackets 84, 86, and selectively connect passages between the jackets 84, 86. Coolant flows from the cylinder head 80 and out of the engine 20 to a radiator 82 or other heat exchanger where heat is transferred from the coolant to the environment.

Figure 2:
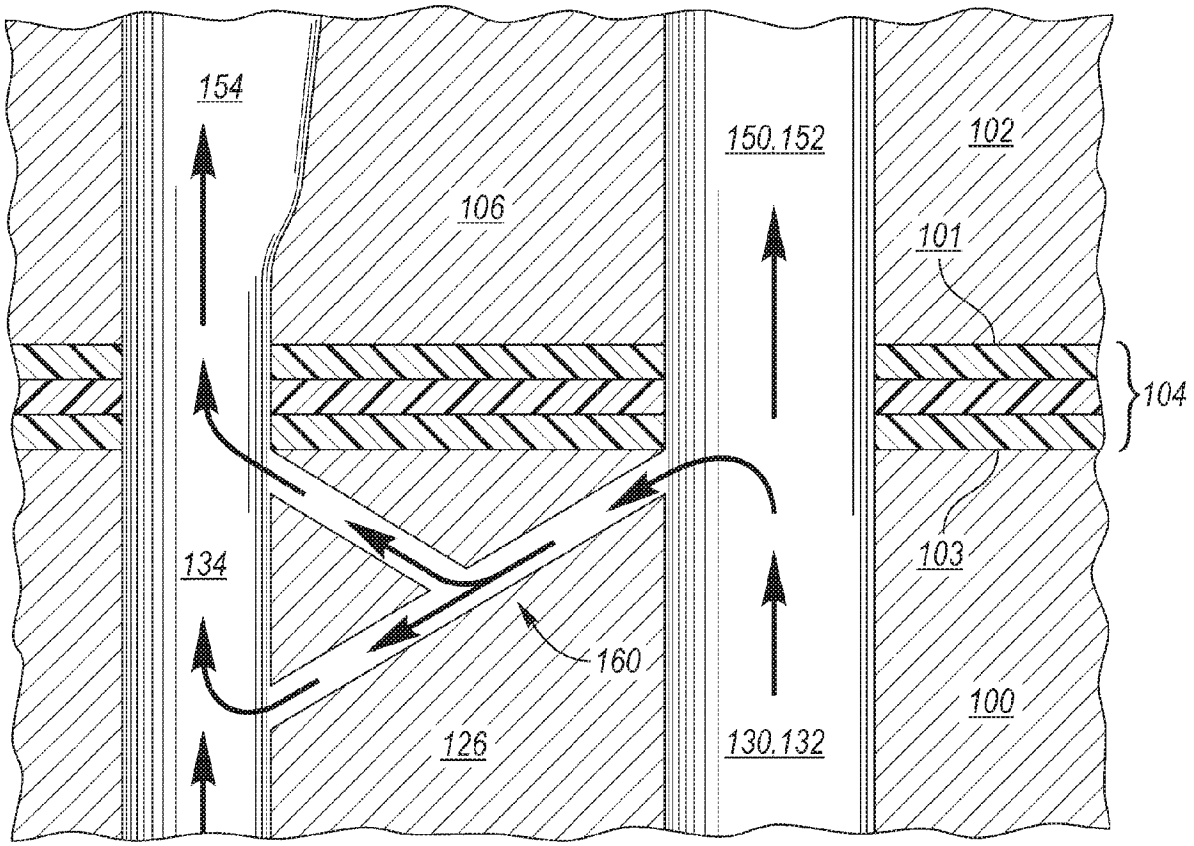
FIG. 2 Prior Art
FIG. 2 illustrates a schematic of cooling paths for a cooling jacket of a conventional engine.

FIG. 2 illustrates a conventional cross drill design for a bore bridge of the engine block. In other conventional engines, the bore bridge may have no cooling passages. FIG. 2 illustrates cooling paths across the bore bridge. The cylinder block 100 of the engine is connected to the cylinder head 102 using a head gasket 104 to form a combustion chamber in the engine. The deck face 103 of the cylinder block 100 and the deck face 101 of the cylinder head 102 are in contact with first and second opposed sides of the gasket 104. The cylinder head 102 has bore bridges 106 between adjacent chambers. The block 100 has bore bridges 126 between adjacent cylinders.

Coolant flows from a block cooling jacket 130 to a head cooling jacket 150. The block jacket 130 has a passage 132 on the intake side of the engine and a passage 134 on the exhaust side of the engine. The head jacket 150 has a passage 152 on the intake side of the engine and a passage 154 on the exhaust side of the engine. The bore bridge 126 defines a conventional y-shaped cross drill passage 160 for cooling. The flow of coolant is illustrated in Figure by arrows. In an example of FIG. 2, a pressure drop across the bore bridge, or at the entrance to 160 from passage 132 and the exit of passage 160 to passage 134, is approximately 500 Pascals.

Figure 3:
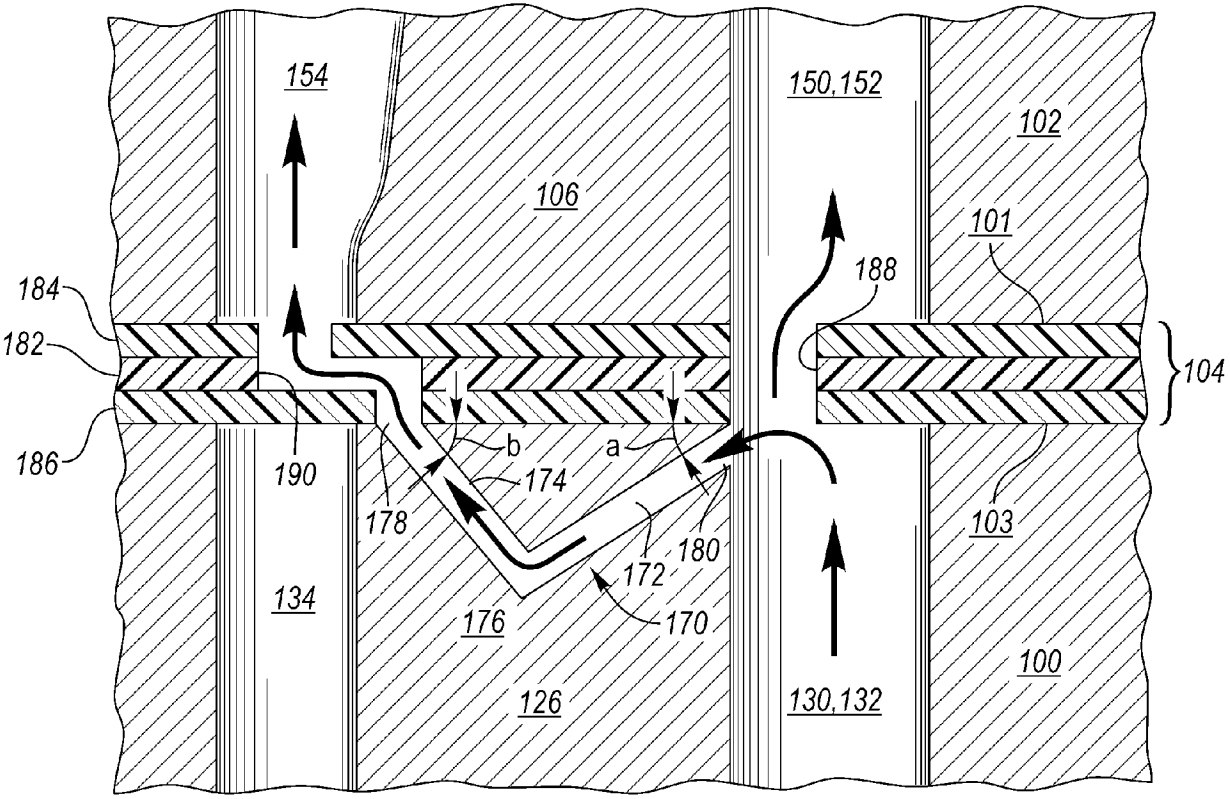
FIG. 3 illustrates a schematic of cooling paths for a cooling jacket of the engine of FIG. 1 according to an embodiment.
Figure 4:
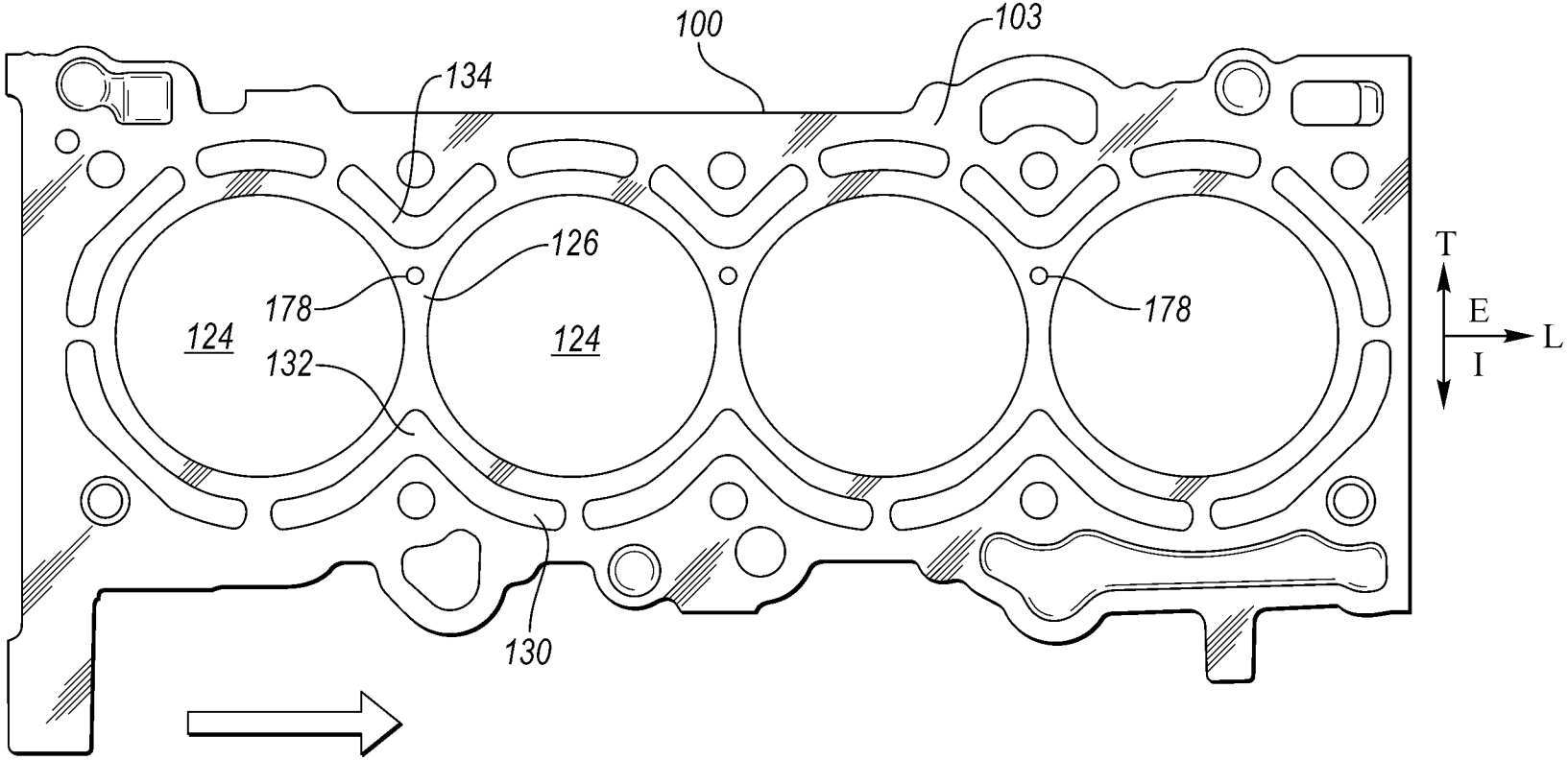
FIG. 4 illustrates a perspective view of a cylinder block according to an embodiment.

FIGS. 3-4 illustrate an example of the present disclosure. FIG. 3 illustrates a schematic of fluid flow across a bore bridge according an example of the present disclosure. FIG. 4 illustrates the cylinder block. Reference numerals in FIG. 2 may also be used with reference to FIGS. 3-5 for similar features.

The cooling system of FIG. 2 may be implemented on the engine illustrated in FIG. 1. FIG. 2 illustrates cooling paths across the cylinder block bore bridge. The cylinder block 100 of the engine is connected to the cylinder head 102 using a head gasket 104 to form a combustion chamber in the engine. The deck face 103 of the cylinder block 100 and the deck face 101 of the cylinder head 102 are in contact with first and second opposed sides of the gasket 104.

Between adjacent chambers in the cylinder head 102 are bore bridges 106. Between adjacent cylinders 124 in the block 100 are bore bridges 126. The chambers in the head 102 and the cylinders in the block 100 cooperate to form combustion chambers for the engine. The gasket 104 may include a bead on each side of the gasket and surrounding the chambers and cylinders to help seal the combustion chambers of the engine.

An embodiment of the engine block 100 is shown in FIG. 4 illustrating the longitudinal axis L and the transverse axis T of the engine, as well as the intake side I and the exhaust side E. Referring back to FIG. 3, coolant flows from a block cooling jacket 130 to a head cooling jacket 150. The block jacket 130 has a passage 132 on the intake side of the engine and a passage 134 on the exhaust side of the engine. Passages 132 and 134 intersect the block deck face 103. The head jacket 150 has a passage 152 on the intake side of the engine and a passage 154 on the exhaust side of the engine. Passages 152, 154 intersect the head deck face 101. The bore bridge 126 is a fluid barrier between passages 132, 134 and is adapted to prevent coolant from flowing directly from the passage 132 to the passage 134 and separate adjacent cylinders in the engine block 100.

The bore bridge 126 defines a v-shaped cross drill passage 170 for cooling. The flow of coolant is generally illustrated in FIG. 3 by arrows. In an example of FIG. 3, a pressure drop across the bore bridge, or at the entrance to 170 from passage 132 and the exit of passage 170 to passage 154, is approximately 8000 Pascals for the same operating conditions as described above with respect to FIG. 2, thereby providing approximately sixteen times greater pressure drop. An increased pressure difference provides a higher flow velocity, and associated higher heat transfer rates, in the bore bridge 126.

The v-shaped passage 170 has a first section of passage 172 and a second section of passage 174. The passage 172 extends from the passage 132 adjacent to the block deck face 103 to an intermediate region 176 of the bore bridge 126. The passage 174 extends from and connects with the passage 172 in the intermediate region 176 of the bore bridge 126. The passage 174 intersects the block deck face 103 adjacent to and spaced apart from the passage 134.

Passage 172 is nonparallel with and intersects the passage 174. The passage 172 is oriented at an acute angle with the block deck face 103 as shown by angle a. The passage 174 is oriented at an acute angle with the block deck face 103 as shown by angle b. The angles a, b, may be the same as one another or may be different from one another. Similarly, the length and/or diameter of passages 172, 174 may be the same as one another or different than one another. The intermediate region 176 of the block bore bridge is spaced apart from the block deck face 103.

An end or exit 178 of the v-shaped passage intersects the block face 103 and is spaced apart from the passage 134. The exit 178 of the v-shaped passage may be aligned with the passage 154 of the head 102, or alternatively, the gasket 104 may be slotted to provide a fluid connection between the exit 178 and the passage 154 as shown in FIG. 3. Another end, or the entrance 180 of the v-shaped passage intersects the cooling passage 152, and may be adjacent to the deck face 103.

Coolant in the block cooling jacket 130 flows from a passage 132 on the intake side, across bore bridge 126, and to a passage 154 in the cooling jacket 150 on the exhaust side of the cylinder head 102. The passage 154 is at a lower pressure than passage 132. Coolant in passage 132 also flows to passage 152 in the jacket 150. The gasket 104 isolates the passage 134 adjacent to the bore bridge, forcing passage 154 to receive coolant from the passage 170, thereby increasing flow across the bore bridge 126.

The head gasket 104 assists in providing the cooling paths as shown in FIG. 2. The gasket 104 has a generally planar gasket body that defines various apertures corresponding to bolt holes or other components of the engine. The gasket 104 also has slots or apertures to form cooling passages to fluidly connect the jackets 130, 150. In one example, the gasket 104 is constructed from multiple layers, and each layer may be made from steel or another suitable material. One or more center layers 182 may be used as a spacer, and it may assist in determining the gasket thickness as well as provide a separating layer. The gasket has at least one upper layer 184 on the head side of the gasket 104. The gasket 104 also has at least one lower layer 186 on the block side of the gasket. The upper layer 184 cooperates with the cylinder head deck face 101, the lower layer 186 cooperates with the cylinder block deck face 103, and the intermediate layer 182 is positioned between the upper and lower layers.

The gasket 104 has a first aperture or slot 188 positioned between passage 132 and passage 152. The aperture 188 may be the same dimensions as the passages 132, 152, or may be smaller in size to restrict flow. The gasket has a second aperture or slot 190 positioned between the exit 178 of the v-shaped passage 170 and the passage 154. The slots 188, 190 may be formed by stamping the layers of the gasket, or by another process as is known in the art. Each slot is positioned between adjacent beads of the gasket. The slots or apertures 188, 190 may be formed by selectively removing gasket material from one or more layers to form a coolant path from the block to the head. Slots may be provided in each layer of the gasket that cooperate to form the coolant path across the gasket, and slots in different layers may be the same length, different lengths, and may be aligned or offset to provide the desired coolant flow pattern. The apertures 188, 190 are spaced apart transversely along the T axis on the gasket.

At least one layer of the gasket 104, such as layer 186, covers the passage 134 at the deck face to prevent flow from the passage 134 to the passage 154 adjacent to the bore bridge 126. Therefore, in the region of the bore bridge 126, passages 132, 152, 170, and 154 are in direct fluid communication, and passage 134 is blocked or fluidly disconnected.

The perimeter of the apertures 188, 190 may be generally triangular, circular, or another shape to correspond with perimeters of associated passages. In some examples, the cross sectional area of the apertures 188, 190 corresponds with the cross sectional area of at least one or the associated passages taken along the deck face to prevent flow restrictions. In other examples, the cross sectional area of the apertures 188, 190 is less than the cross sectional area of at least one or the associated passages taken along the deck face to provide a flow restriction to control flow. The apertures 188, 190 may also have a diverging cross sectional area or a converging cross sectional area across the gasket 104 to control flow, for example, to control a fluid streamline.

Although the coolant is described as flowing from the intake side of the engine to the exhaust side, in other embodiments, the coolant may flow in the opposite direction, i.e. from the exhaust side to the intake side, and the v-shaped passage 170 may be reversed.

Coolant flow through the engine is generally shown by the arrows in FIG. 3. The gasket 104 may provide a coolant flow path from the block 100 to the head 102 through the bore bridge 126. The gasket 104 may provide a barrier at passage 134, thereby causing the coolant to flow transversely from an intake side to an exhaust side of the engine across the bore bridge.

Coolant in the cylinder head passages in the block deck face may travel along a longitudinal axis or longitudinal direction L of the engine such that coolant is provided to the cylinders in a sequential manner.

FIG. 4 illustrates a partial top perspective view of a cylinder block 100 employing an embodiment of the present disclosure. The cylinder block 100 may be cast out of a suitable material such as aluminum. The cylinder block 100 is a component in an in-line four cylinder engine, although other engine configurations may also be used with the present disclosure. The cylinder block 100 has a deck face 103 or top face that forms cylinders 124. The deck face 103 may be formed to provide a semi-open deck design as illustrated. Each cylinder 124 cooperates with a corresponding chamber in the head 102 to form the combustion chamber. Each cylinder 124 has an exhaust side E that corresponds to the side of the head with the exhaust ports, and an intake side I that corresponds to the side of the head with the intake ports. Various passages are also provided on the deck face 103 and within the cylinder block 100 that form a cooling jacket 130 for the cylinder block and engine. The cooling jacket 130 may cooperate with corresponding ports associated with a head cooling jacket to form an overall cooling jacket for the engine. Coolant in the cylinder block passages in the block deck face may travel along a longitudinal axis or longitudinal direction L as shown by the arrow in FIG. 4 of the engine such that coolant is provided to the cylinders in a sequential manner.

A bore bridge 126 is formed between a pair of cylinders 124. The bore bridge 126 may require cooling with engine operation as the temperature of the bridge 126 may increase due to conduction heating from hot exhaust gases in the combustion chamber. The exit 178 of a v-shaped passage 170 is illustrated and is adjacent to and spaced apart from the passage 134. The exit 178 intersects the deck face 103.

Figure 5:
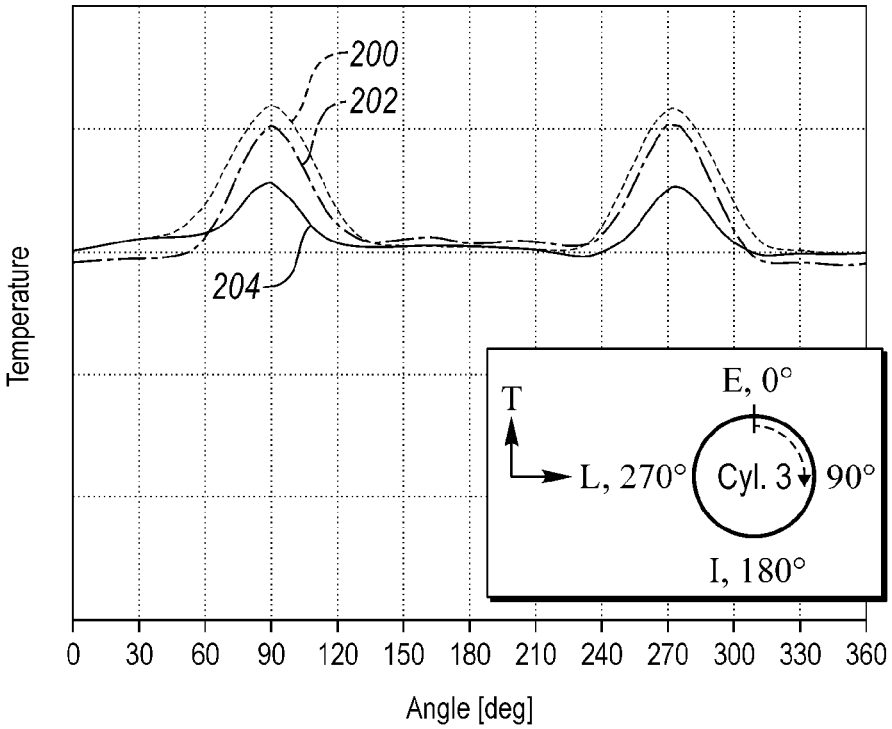
FIG. 5 illustrates a graph of surface temperature around a cylinder bore and compares the cooling paths of the present disclosure to conventional engines.
Figure 6:
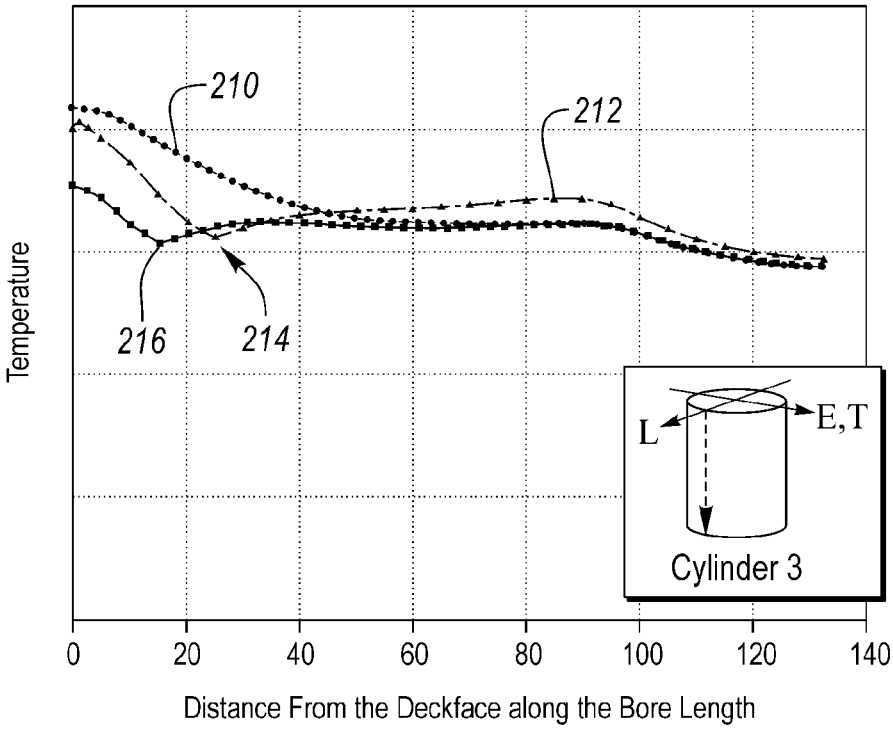
FIG. 6 illustrates a graph of surface temperature as a function of bore length of a cylinder and compares the cooling paths of the present disclosure to conventional engines.
Figure 7:
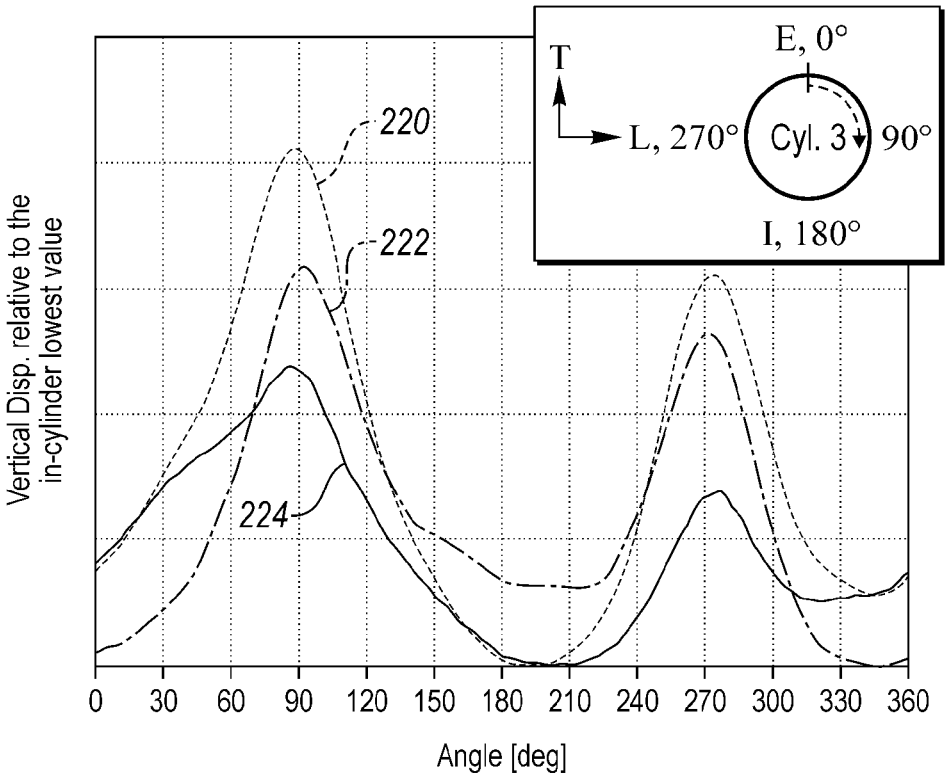
FIG. 7 illustrates a graph of the vertical displacement of the bore edge relative to the in-cylinder lowest value around a cylinder bore and compares the cooling paths of the present disclosure to conventional engines.

FIGS. 5-7 illustrate modeling results comparing an engine without a bore bridge cooing passage, an engine with a bore bridge cooling passage according to FIG. 2, and a bore bridge cooling passage 170 according to FIG. 3 and the present disclosure. The results were calculated for the number three cylinder in the engine, which encounters the greatest heating and/or displacement of the engine bore bridges. Generally, the Figures show that the passage 170 provides a high pressure drop across the passage 170 which increases the coolant flow and heat transfer significantly. The passage 170 reduces bore bridge temperature, reduces the temperature and displacement gradient around the bore edge, and reduces bore wall temperature along the bore length. In one example, a temperature of the bore bridge and a maximum block temperature using a passage 170 are reduced by approximately thirty degrees Celsius compared to an engine with no bore bridge cooling passage. For comparison, a temperature of the bore bridge and a maximum block temperature using a passage 160 are reduced by approximately ten degrees Celsius compared to an engine with no bore bridge cooling passage.

FIG. 5 illustrates a surface temperature around a cylinder bore adjacent to the deck face 103. The surface temperature is plotted as a function of angle in degrees around the cylinder. The longitudinal axis of the engine, or the center of the bore bridges, is at 90 degrees and 270 degrees. The temperature of the cylinder bore with no bore bridge cooling passages is shown by line 200, and the temperature peaks at the angular position associated with the bore bridges. The temperature of the cylinder bore with cooling passages 160 in the bore bridges as shown in FIG. 2 is shown by line 202, which provides some temperature relief compared to line 200. The temperature of the cylinder bore with cooling passages 170 in the bore bridges as shown in FIG. 3 according to the present disclosure are shown by line 204, which provides significant temperature relief compared to lines 200 and 202.

FIG. 6 illustrates a surface temperature of a cylinder bore as a function of bore length, with increasing bore depth away from the deck face. In FIG. 6, a distance of zero is associated with the deck face 103 of an engine block. The surface temperature was calculated for the cylinder bore at an angular position of 90 degrees as described with respect to FIG. 5 along a bore bridge. The longitudinal axis of the engine, or the center of the bore bridge, is at 90 degrees. The temperature of the cylinder bore with no bore bridge cooling passages is shown by line 210, and the temperature peaks at the deck face 103. The temperature of the cylinder bore with cooling passages 160 in the bore bridges as shown in FIG. 2 is shown by line 212, which provides some temperature relief compared to line 210. The dip at 214 may be attributed to the lower passage connecting to passage 134 in FIG. 2. The temperature of the cylinder bore with cooling passages 170 in the bore bridges as shown in FIG. 3 according to the present disclosure are shown by line 216, which provides improved temperature relief compared to lines 210 and 212 adjacent to the deck face 103.

FIG. 7 illustrates a graph of the vertical displacement of the bore edge relative to the in-cylinder lowest value around a cylinder bore. The relative vertical displacement is determined by subtracting the minimum vertical displacement for the cylinder from the vertical displacement curve around the cylinder. The relative vertical displacement is plotted as a function of angle in degrees around the cylinder. The longitudinal axis of the engine, or the center of the bore bridges, is at 90 degrees and 270 degrees. The relative vertical displacement is greatest at the bore bridges due to the increased temperature of the bore bridges and associated thermal expansion. The relative vertical displacement of the cylinder bore with no bore bridge cooling passages is shown by line 220. The relative vertical displacement of the cylinder bore with cooling passages 160 in the bore bridges as shown in FIG. 2 is shown by line 222, which provides some vertical displacement relief compared to line 220. The vertical displacement of the cylinder bore with cooling passages 170 in the bore bridges as shown in FIG. 3 according to the present disclosure are shown by line 224, which provides improved vertical displacement relief compared to lines 220 and 222.

Various embodiments of the present disclosure have associated, non-limiting advantages. For example, by providing a v-shaped passage or another passage across the bore bridge to provide coolant flow from a block cooling jacket to a head cooling jacket on an opposed side of a bore bridge, the bore bridge temperature, cylinder temperature, and relative cylinder vertical displacement may be reduced. A gasket fluidly connects the block cooling jacket and the head cooling jacket on a first side of the bore bridge. The bore bridge cooling passage is fluidly connected to the block jacket on the first side of the bridge and spaced apart from and fluidly disconnected from the block cooling jacket on the second, opposed side of the bore bridge. The gasket fluidly connects the bore bridge passage to the head cooling jacket on the second side of the bore bridge. The gasket covers the block cooling jacket on the second side of the bore bridge to prevent coolant flow from the block jacket to the head jacket on the second side of the bore bridge. The bore bridge cooling passage and head gasket provide for an increased pressure drop across the bore bridge, providing for increased coolant velocity and increased heat transfer of the bore bridge.

While exemplary embodiments are described above, it is not intended that these embodiments describe all possible forms of the present disclosure. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An internal combustion engine comprising:

a cylinder block defining a block deck face, first and second cylinders, and a block cooling jacket, wherein the first and second cylinders are adjacent to one another and separated by a block bore bridge;

a cylinder head having a head deck face defining first and second chambers, and a head cooling jacket, the first and second chambers adjacent to one another and separated by a head bore bridge, wherein the first chamber and the first cylinder form a first combustion chamber, and the second chamber and the second cylinder form a second combustion chamber; and a head gasket positioned between the cylinder block and the cylinder head, the head gasket having a block side and a head side;

wherein the block cooling jacket has a first passage and a second passage intersecting the block deck face on either side of the block bore bridge, the first passage on a first side of a longitudinal axis of the cylinder block;

wherein the head cooling jacket has a third passage and a fourth passage intersecting the head deck face on either side of the head bore bridge, the third passage on the first side of the longitudinal axis of the cylinder block;

wherein the block bore bridge defines a bridge cooling passage having an entrance intersecting the first passage and the block deck face and an outlet intersecting the block deck face adjacent to the second passage;

wherein the head gasket defines a first aperture positioned between the outlet of the bridge cooling passage and the fourth passage to fluidly connect the first and fourth passages such that coolant flows from the first passage, through the bridge cooling passage, and to the fourth passage to cool the associated bore bridge;

wherein the head gasket forms a second aperture positioned between and fluidly connecting the first passage and the third passage; and wherein the head gasket covers the second passage thereby preventing coolant from flowing from the second passage to the fourth passage.

2. The internal combustion engine of claim 1 wherein each of the chambers have an exhaust port opposed to an intake port, wherein the intake port is positioned on the first side of the longitudinal axis of the cylinder block.

3. The internal combustion engine of claim 1 wherein the bridge cooling passage is oriented at an acute angle with the block deck face.

4. The internal combustion engine of claim 1 wherein the bridge cooling passage defines a bend in an intermediate region of the bore bridge.

5. The internal combustion engine of claim 4 wherein the intermediate region of the block bore bridge is spaced apart from the block deck face.

6. The internal combustion engine of claim 1, wherein the entrance to the bridge cooling passage is the sole entrance, and wherein the outlet from the bridge cooling passage is the sole outlet.

7. The internal combustion engine of claim 1 wherein the bridge cooling passage is v-shaped formed from a first section of passage at a first acute angle relative to the block deck face and a second section of passage at a second acute angle relative to the deck face, the first and second sections intersecting in an intermediate region of the block bore bridge.

8. An engine comprising:

a cylinder block having first and second passages intersecting a block face on opposed sides of a bore bridge defining a v-shaped passage having a sole entrance and a sole outlet;

a cylinder head having third and fourth passages intersecting a head face, the first and fourth passages being opposed; and a gasket defining an aperture fluidly connecting the first and fourth passages via the v-shaped passage, and covering the second passage.

9. The engine of claim 8 wherein the outlet of the v-shaped passage intersects the block face and is spaced apart from the second passage.

10. The engine of claim 9 wherein the outlet of the v-shaped passage is aligned with the fourth passage of the head.

11. The engine of claim 9 wherein the entrance to the v-shaped passage intersects the first passage and the block face.

12. The engine of claim 8 wherein the gasket defines another aperture positioned between and fluidly connecting the first and third passages.

13. The engine of claim 12 wherein the aperture and the another aperture are transversely spaced from one another across the bore bridge.

14. The engine of claim 8 wherein the third and fourth passages are adapted to be at a lower pressure than the first passage.

15. The engine of claim 8 wherein the first and second passages and the v-shaped passage form a block cooling jacket.

16. The engine of claim 8 wherein the third and fourth passage form a head cooling jacket.

17. The engine of claim 8 wherein the bore bridge provides a fluid barrier between the first passage and the second passage and is adapted to prevent coolant from flowing across the bore bridge from the first passage to the second passage.

18. The engine of claim 8, wherein adjacent to the bore bridge, the first, third, fourth, and v-shaped passages are in direct fluid communication across the gasket, and the second passage is blocked.

19. A head gasket for an engine having a cooling jacket comprising:

a generally planar gasket body having a first side for cooperation with a cylinder head deck face, and a second side for cooperation with a cylinder block deck face, the gasket body comprising an upper layer, a lower layer, and a support layer positioned therebetween, the gasket having formed therein:

a first slot extending through the gasket body and adjacent to a cylinder block bore bridge, the first slot fluidly connecting a first cooling passage in a cylinder block and a second cooling passage in a cylinder head, the first and second cooling passages being aligned; and a second slot extending through the gasket body and adjacent to the cylinder block bore bridge, the second slot fluidly connecting a bridge cooling passage in the cylinder block bore bridge receiving fluid from the first passage and a third cooling passage in the cylinder head;

wherein the first and second slots are spaced apart transversely on the gasket; and wherein the lower layer of the gasket body is adapted to cover a fourth passage in the cylinder block, the fourth passage adjacent to the bridge cooling passage, the lower layer defining a first aperture overlapping an outlet of the bridge cooling passage;

wherein the upper layer defines a second aperture overlapping the third cooling passage in the head, the second aperture offset from and non-overlapping with the first aperture;

wherein the support layer defines a third aperture overlapping and fluidly connecting the first and second apertures; and wherein the first, second and third apertures cooperate to form the second slot.

* * * * *